US009181643B2

(12) United States Patent
Münstermann

(10) Patent No.: US 9,181,643 B2
(45) Date of Patent: Nov. 10, 2015

(54) DEVICE AND METHOD FOR PRODUCING A NONWOVEN COMPOSITE FABRIC

(75) Inventor: Ullrich Münstermann, Egelsbach (DE)

(73) Assignee: TRÜTZSCHLER NONWOVENS GMBH, Egelsbach (DE)

( * ) Notice: Subject to any disclaimer, the term of this patent is extended or adjusted under 35 U.S.C. 154(b) by 33 days.

(21) Appl. No.: 13/980,642

(22) PCT Filed: Jan. 20, 2012

(86) PCT No.: PCT/EP2012/050857
§ 371 (c)(1),
(2), (4) Date: Jul. 19, 2013

(87) PCT Pub. No.: WO2012/098223
PCT Pub. Date: Jul. 26, 2012

(65) Prior Publication Data

US 2013/0291355 A1 Nov. 7, 2013

(30) Foreign Application Priority Data

Jan. 22, 2011 (DE) ..... 10 2011 009 227

(51) Int. Cl.
*D04H 5/03* (2012.01)
*D04H 1/492* (2012.01)
*D04H 1/498* (2012.01)

(52) U.S. Cl.
CPC ..... *D04H 5/03* (2013.01); *D04H 1/492* (2013.01); *D04H 1/498* (2013.01)

(58) Field of Classification Search
CPC ..... D04H 5/03; D04H 1/498; D04H 1/465; D04H 1/49; D04H 1/492; D04H 18/04; D21F 1/0027; D21F 1/0036; D21F 7/083
USPC ..... 28/104, 105, 110, 142, 167, 103
See application file for complete search history.

(56) References Cited

U.S. PATENT DOCUMENTS 3,166,823 A * 1/1965 Bernard ..... 28/110
3,375,561 A * 4/1968 Ford ..... 28/110
3,458,911 A * 8/1969 Koester ..... 28/110
4,357,386 A * 11/1982 Luciano et al. ..... 442/30
4,369,081 A * 1/1983 Curry et al. ..... 156/148

(Continued)

FOREIGN PATENT DOCUMENTS

DE 93 11 628 U1 9/1993
DE 44 10 110 C2 11/1995

(Continued)

*Primary Examiner* — Amy Vanatta

(57) ABSTRACT

The invention relates to a device for producing a nonwoven composite fabric. A nonwoven fabric layer is applied onto a support structure layer and connected to said layer by means of water jet needling. According to the invention, the following are provided:

Figure 1:
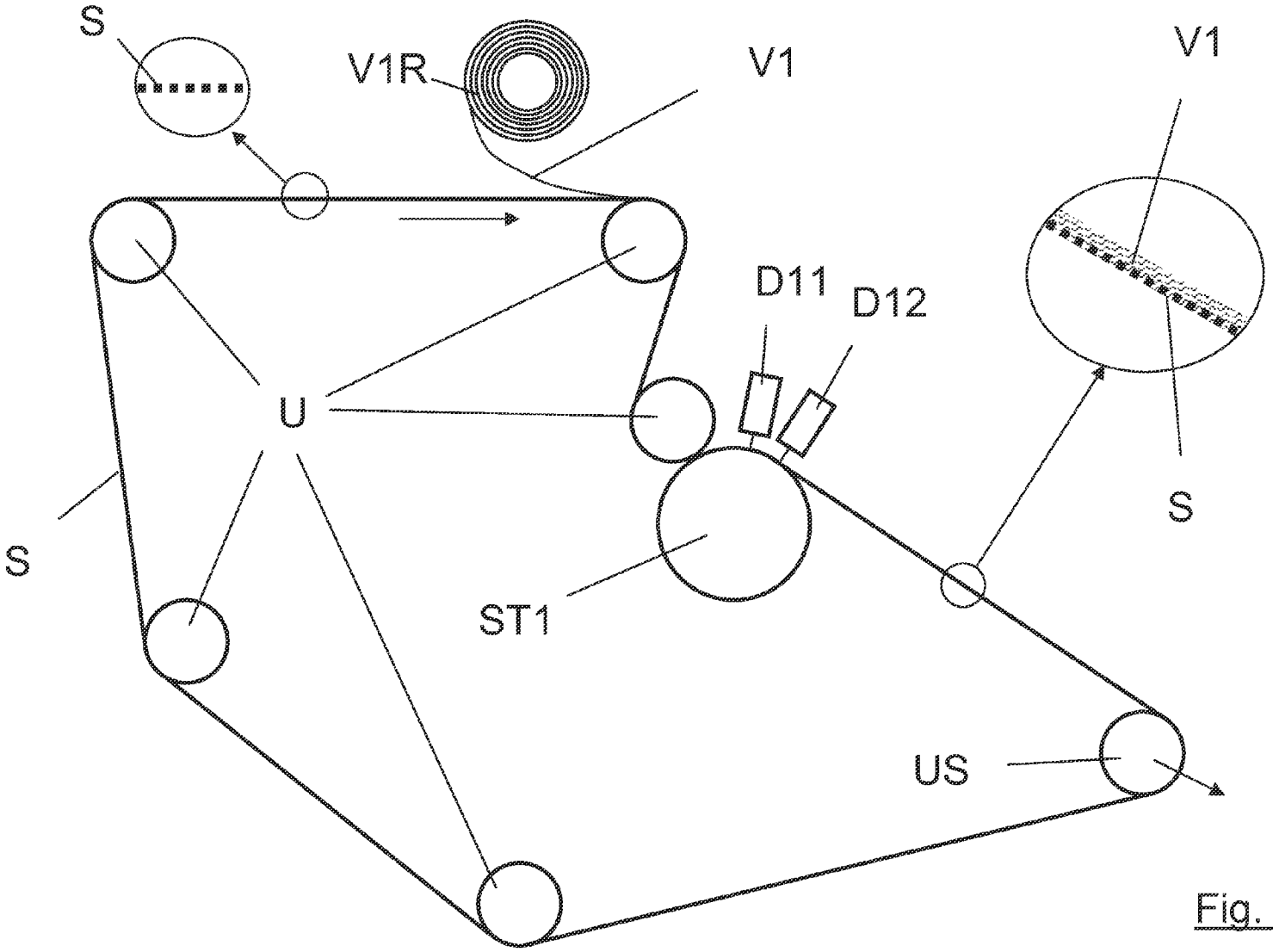

a number of deflecting rollers (U, US) around which a support structure (S) in the form of a screen or a mesh fabric is stretched and circulated, said support structure being designed as a continuous strip;

a feeding device (V1R) for a nonwoven fabric (V1), which is brought into contact with the support structure (S) and further moved in contact with same; and a device for water jet needling (D11, D12, ST1), by means of which the nonwoven fabric (V1) is connected to the support structure (S).

14 Claims, 5 Drawing Sheets

(56) References Cited

U.S. PATENT DOCUMENTS

| | | | | |
|---|---|---|---|---|
| 4,425,392 | A * | 1/1984 | Oikawa et al. | 428/90 |
| 4,482,601 | A * | 11/1984 | Hartigan, Jr. | 442/274 |
| 4,649,074 | A | 3/1987 | Borel | |
| 5,334,446 | A | 8/1994 | Quantrille et al. | |
| 5,864,931 | A * | 2/1999 | Best et al. | 28/110 |
| 5,960,525 | A * | 10/1999 | Fleissner | 28/104 |
| 6,027,615 | A * | 2/2000 | Davenport et al. | 162/358.2 |
| 6,063,717 | A * | 5/2000 | Ishiyama et al. | 442/387 |
| 6,723,208 | B1 * | 4/2004 | Hansen | 162/358.2 |
| 7,500,292 | B2 * | 3/2009 | Miller et al. | 28/104 |
| 7,611,594 | B2 * | 11/2009 | Sommer et al. | 156/148 |
| 8,763,219 | B2 * | 7/2014 | Jonsson et al. | 28/104 |
| 2001/0027594 | A1 * | 10/2001 | Fleissner | 28/107 |
| 2002/0115368 | A1 * | 8/2002 | Yook et al. | 442/224 |
| 2004/0126545 | A1 * | 7/2004 | Toney et al. | 428/196 |
| 2006/0019567 | A1 * | 1/2006 | Sayers | 442/218 |

FOREIGN PATENT DOCUMENTS

| | | | |
|---|---|---|---|
| DE | 103 16 259 | A1 | 10/2004 |
| DE | 103 49 298 | B4 | 3/2006 |
| DE | 10 2009 016 996 | A1 | 10/2010 |
| DE | 10 2009 024 057 | A1 | 12/2010 |
| EP | 0 211 410 | A2 | 2/1987 |
| EP | 0 226 471 | A2 | 6/1987 |
| EP | 1 126 066 | A1 | 8/2001 |
| WO | WO 02/35000 | A1 | 5/2002 |
| WO | WO 2008/110134 | A1 | 9/2008 |

* cited by examiner

DEVICE AND METHOD FOR PRODUCING A NONWOVEN COMPOSITE FABRIC

The invention relates to a device for producing a nonwoven composite fabric in which a nonwoven fabric layer is applied onto a support structure layer and connected to the layer by means of water jet needling, as well as to a method for producing a nonwoven composite fabric.

Nonwoven composite fabrics are known from a number of documents. For example, DE 44 10 110 C2 shows a filter material for cleanable separators. A supporting fabric is surrounded on both sides by a nonwoven layer, the fibers being swirled through the opening of the metal fabric by means of water jets.

DE 93 11 628 U1 describes a filter material constituted by a carrier material in the form of a thread structure, as well as by a coarse and a fine fiber layer. The layers are connected with each other through needling.

A multi-layer composite structure, which may also include metal fibers, is known from DE 103 16 259 A1. The layers are needled with each other using water jets under high pressure (<200 mbar).

A support fabric for filters is known from DE 103 49 298 B4, the fabric being surrounded by fibers on both sides. During production, needling and in particular the application of water jets under high pressure are used.

A filter fleece including PTEF fibers and glass fibers, connected with a fabric by water jet needling, is known from EP 0 226 471 A2.

An elastomeric fabric enclosed between two nonwoven layers is described in U.S. Pat. No. 5,334,446. The layers are connected with each other by water jet needling in the tensioned, stretched state of the fabric receiving the layers.

The nonwoven composite fabrics described in the documents are roll products. For some applications, e.g., paper production, however, endless nonwoven composite fabrics are needed as well.

It is an object of the invention to provide a device and a method with which endless nonwoven composite fabrics van be produced in a particularly simple and economic manner.

This object is achieved with a device for producing a nonwoven composite fabric, wherein a nonwoven fabric layer is applied onto a support structure layer and connected to the support structure layer by means of water jet needling, and in which a number of deflecting rollers around which a support structure in the form of a screen or a mesh fabric is stretched and circulated, the support structure being designed as a continuous strip, a feeding device for a nonwoven fabric, which is brought into contact with the support structure and further moved in contact with same, and a device for water let needling, by means of which the nonwoven fabric is connected to the support structure.

The device can include a stretching means by which the support structure is stretched in at least one direction in the region of water jet needling.

The device can include a compacting means by means of which the nonwoven supplied to the support structure is contacted with the same and is supplied to the means for water jet needling.

The device can include another supply means for another nonwoven layer contacted with the support structure on the other side thereof and moved on to a further water jet needling means, while in contact with the support structure.

The object is also achieved by a method for producing a nonwoven composite fabric by stretching a support structure in the form of a continuous strip over a number of deflecting rollers and circulating the support structure around the deflecting rollers, laying a nonwoven on a first side of the support structure in the form of a continuous strip, and acting on the nonwoven laid on the support structure using of water jets under pressure from a water jet needling means so that the nonwoven is connected with the support structure.

In the region where the water jet is applied, the support structure can be stretched in at least one direction by means of a stretching means.

A second nonwoven can be laid on a second side of the support structure, opposite the first side, and can be connected with the support structure by means of water lets under pressure.

According to the invention, the following are provided:

- a number of deflecting rollers around which a support structure in the form of a screen or a mesh fabric is stretched and circulated, said support structure being designed as a continuous strip;
- a feeding device for a nonwoven fabric, which is brought into contact with the support structure and further moved in contact with same; and
- a device for water jet needling, by means of which the nonwoven fabric is connected to the support structure.

The following developments are provided:

- a stretching means by which the support structure is stretched at least in one direction in the region of the water jet needling. Tensioning the screen or mesh fabric is effected simply in the direction of circulation of the support structure, i.e. the strip is tensioned in the circumferential direction. This is preferably effected by means of one of the deflecting rollers. In addition and as a further development, it is also possible to tension the fabric and the mesh transversely to the direction of movement, i.e. across the width of the strip, for which purpose tensioning devices have to be provided that cooperate with the strip edge and circulate with the same in the water jet needling region.
- a compacting means by means of which the nonwoven supplied to the support structure is contacted with the same and is supplied to the means for water jet needling. The compacting means is formed by a roller or, preferably, by a screen band stretched around rollers, by means of which a voluminous nonwoven is compressed and is subjected to a first water jet needling in particular in the compressed state.
- another supply means for another nonwoven layer contacted with the support structure on the other side thereof and moved on to a further water jet needling means, while in contact with the support structure. A supply means for one or both nonwoven layers substantially consists of a roller supplying the nonwoven. In addition, guide and pressure rollers may be provided, by which the nonwoven placed on the support structure is pressed against the same.

For the implementation of the invention it is provided that the support structure configured as a continuous strip circulates at least one and is thus—except for an overlap area—covered by exactly one layer of nonwoven with which it is connected. Further, it is possible to let the support structure strip circulate several times and to place a plurality of layers of nonwoven on each side of support structure and to fix and compact these thereon.

After one or a plurality of cycles, the product thus obtained can be taken from the deflecting rollers and, after inversion, be placed in the present device again. The support structure now travels around the deflecting rollers on the nonwoven side applied thereon before, while a new nonwoven layer is placed on the support structure, which is on the outer side, and is needled hydrodynamically with the support structure during circulation. Also in this second treatment pass, one or more cycles are possible, whereby one or a plurality of nonwoven layers are applied correspondingly. Of course, it is possible to apply a different type of nonwoven in this second treatment step, having a different mass per unit area, a different fiber structure and thus different properties.

According to a development of the invention, it is possible to apply the nonwoven layers on both sides of the support structure during a single cycle, i.e. without removing the support structure strip and reinstalling it in an inverted manner. In this case, the device of the present invention comprises two supply means, the first supply means supplying a first nonwoven layer onto one side of the support structure strip, and the second supply means supplying a second nonwoven layer onto the second side of the support structure strip. Corresponding to the two supply means for the two nonwoven layers, two means for water jet needling are provided by means of which the nonwoven layers surrounding the support structure strip on either side thereof are needled with the support structure.

The device of the present invention is suited preferably for the production of felts (wet felt, dry felt) as used in the production of paper. Hose filters for the production of cement, for instance, can also be produced.

In a product example, the support structure used is a monofil screen fabric with a mass per unit area of 700 g/m$^2$. The density of the weft and warp threads is between 80 and 90 wires/10 cm. The screen fabric is enclosed on both sides by one nonwoven layer (fibers between 2o and 40 dtex), respectively, with a mass per unit area of 150-300 g/m$^2$, and is water-jet needled from both sides for this purpose.

Water-jet needling on either side of the support structure is effected by means of two nozzle bars having a hole diameter between 0.1 and 0.2 mm, he hole density being between 10 and 40 holes per inch (Hpi). In the concrete example, the water pressure in the first nozzle bar (seen with respect to the movement of the strip) was 50 bar—hole diameter 0.12—40 Hpi—holes in a row—distance nozzle strip-nonwoven support or screen drum 26 mm (hereunder these indications will be given as follows: 50 bar—0.12-40-1 26 mm). In the second bar, the values of the pressure and the nozzle strip were: 350 bar—0.20-10-1 10 mm.

After the strip (the now existing nonwoven support structure) has been inverted and repositioned, another nonwoven layer is laid on the second side of the support structure during the second pass. The first and second nozzle bars act thereon with the values 50 bar—0.12-40-1 26 mm and 350 bar—0.20-10-1 10 mm, respectively.

These cycles in which each side of the support structure has been provided with one nonwoven layer, respectively, can be followed by further passes in which the nonwoven layers applied are compacted without further supply of nonwoven. Likewise, in the following passes further nonwoven layers may be applied and be compacted with the support and the subjacent layers.

Further, according to the present invention, a method for producing a nonwoven composite fabric is provided which comprises the following steps:

stretching a support structure in the form of a continuous strip over a number of deflecting rollers and circulating the support structure around the deflecting rollers, laying a nonwoven on a first side of the support structure in the form of a continuous strip, acting on the nonwoven laid on the support structure using of water jets under pressure from a water jet needling means so that the nonwoven is connected with the support structure.

The support structure is stretched over at least two, preferably at least four deflecting rollers and is circulated around the same.

In the region, where the water jet is applied, the support structure can be stretched in at least one direction by means of a stretching means.

A second nonwoven can be laid on a second side of the support structure, opposite the first side, and can be connected with the support structure by means of water jets under pressure.

Further, a system formed by a device and a support structure for producing a nonwoven composite fabric is provided, wherein at least one layer of nonwoven can be laid on the support structure and be connected with the same using water jet needling. The device comprises at least a feeding device with which the nonwoven can be laid on the support structure, and at least one means for water jet needling by which the nonwoven can be connected with the support structure. The support structure is configured as a continuous strip and the device comprises a number of deflecting rollers, wherein the support structure in the form of a continuous strip is stretched over the number of deflecting rollers and is adapted to be circulated around the same.

Embodiments will be explained hereinafter with reference to the drawings.

Figure 2:
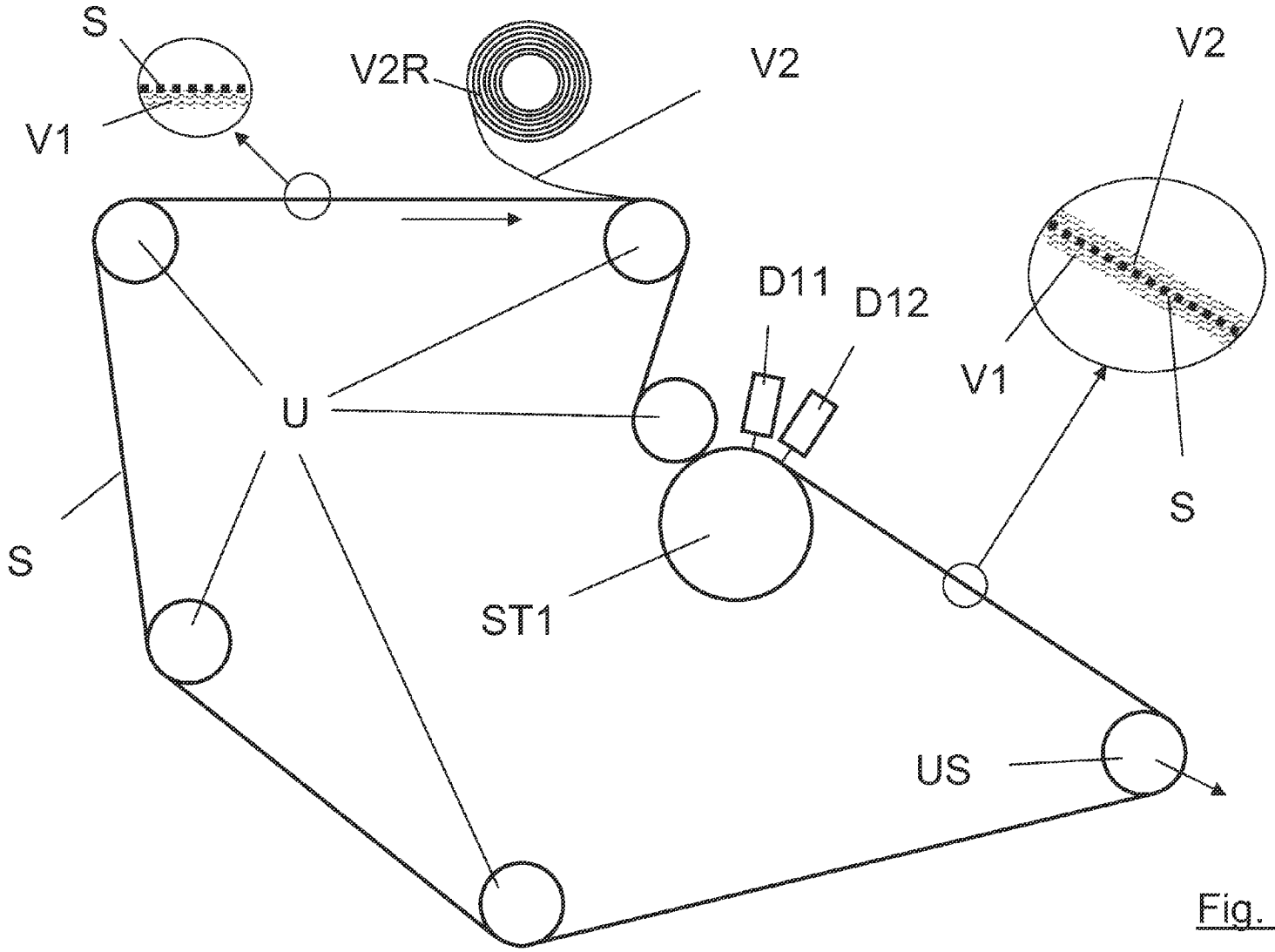
Figure 3:
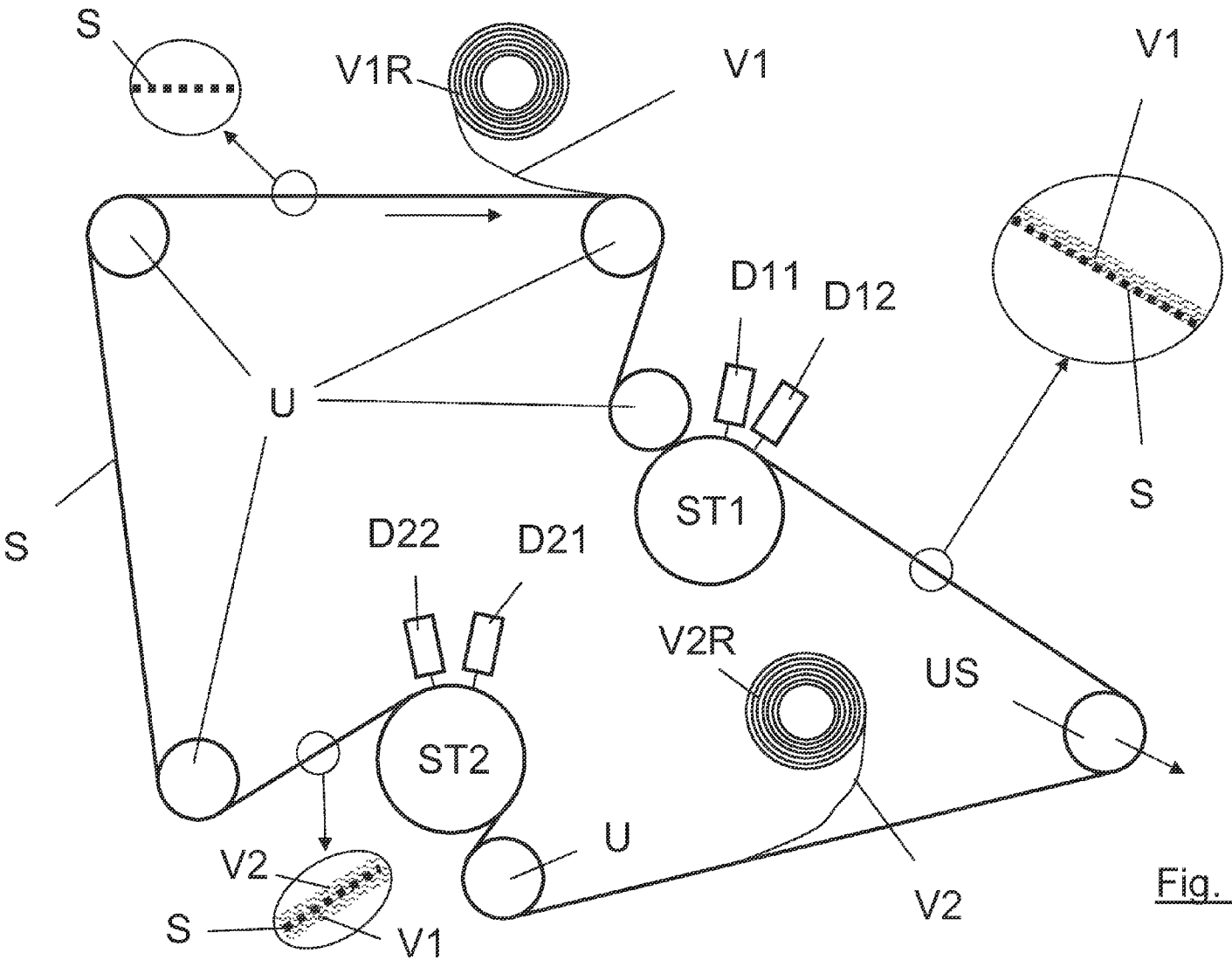
Figure 4:
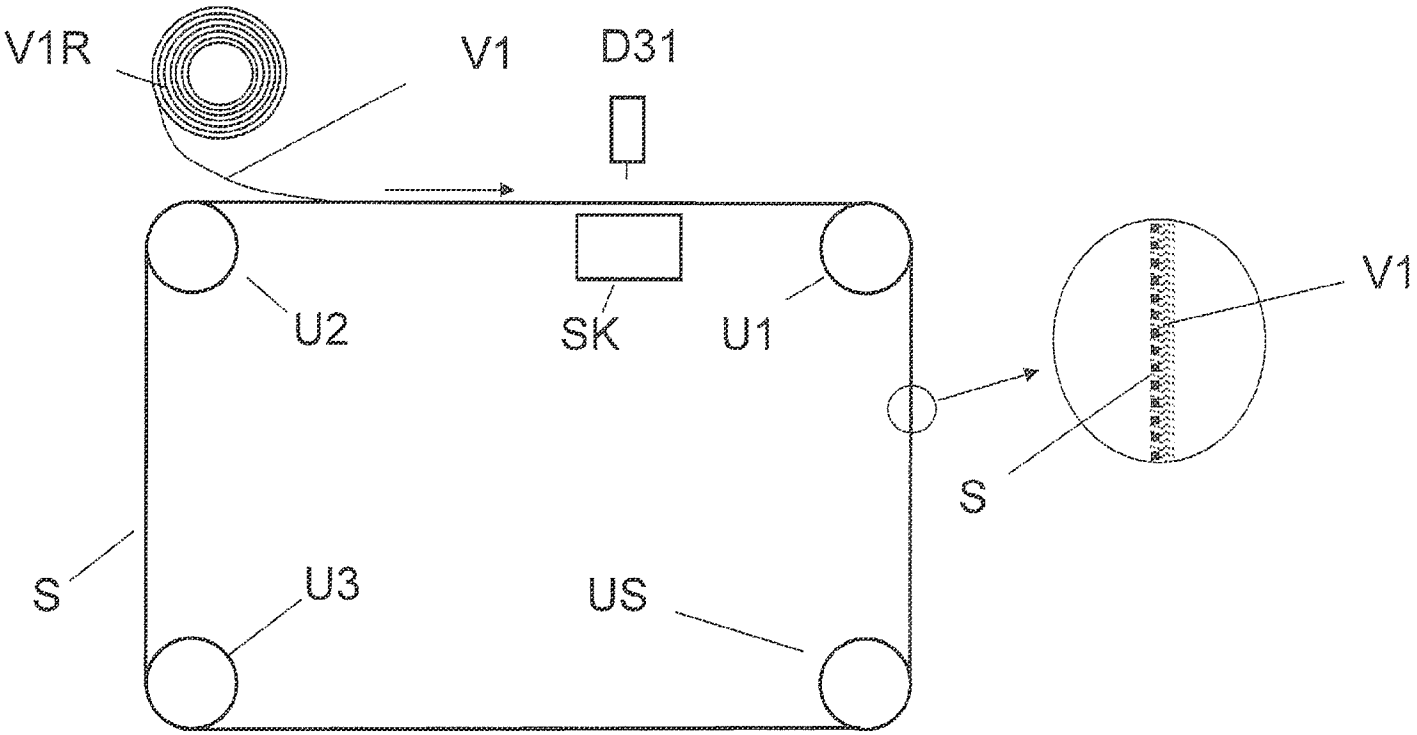
Figure 5:
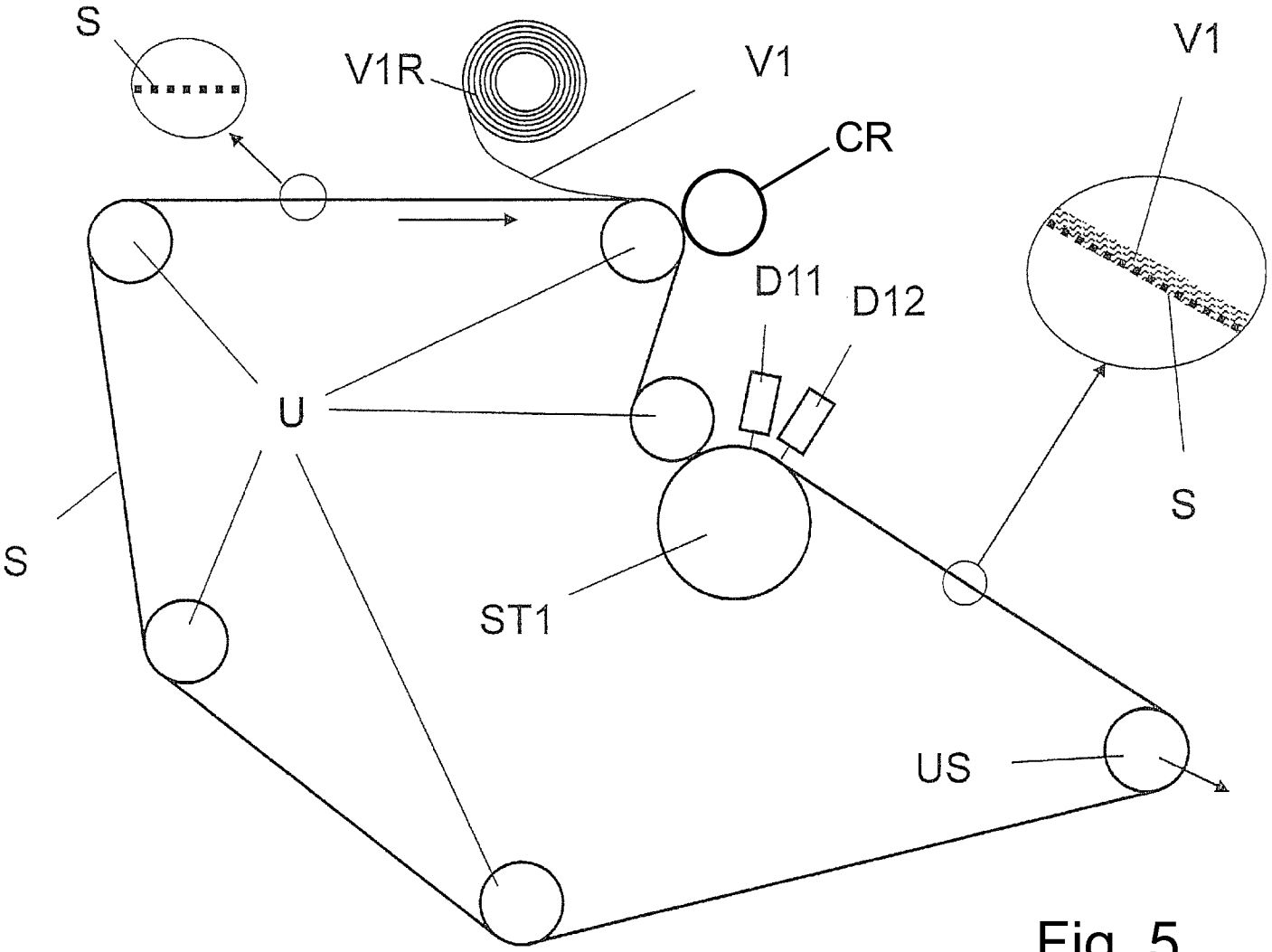

The Figures schematically show:

FIG. 1 a device for receiving a support structure designed as a closed (continuous) strip, FIG. 2 the device of FIG. 1, with a second nonwoven layer being applied onto the second side of the support structure, FIG. 3 another embodiment, FIG. 4 a further embodiment, FIG. 5 a variation of the embodiment of FIG. 1.

FIG. 1 illustrates a device for receiving a support structure S designed as a closed or continuous strip which, in this embodiment, is in the form of a screen fabric and has corresponding openings. The strip is drawn around a number of deflecting rollers U and is stretched by means of an adjustable deflecting roller US. The stretching direction of the deflecting roller US serving for stretching is indicated by the arrow.

The stretched strip of the support structure runs in the direction indicated by the arrow around the deflecting rollers U, US, as well as a needling drum designed as a screen drum ST1 with a suctioning means not illustrated. The suction drum is associated with two nozzle bars D11, D12 which can be supplied with water under high pressure and are connected for this purpose with a high-pressure pump not illustrated. Nozzle strips having a particular hole distance and a particular hole size are placed in the nozzle bars D11, D12.

From a roll of nonwoven V1R as the feeding device, a nonwoven or first nonwoven layer V1 is taken and is laid on the strip of the support structure S. Together with the support structure, the nonwoven V1 lying on the support structure S moves onto the suction drum ST1, where the nozzle bars D11, D12 act thereon hydrodynamically. i.e. the nonwoven is acted upon using water jets under high pressure. Due to the stretching applied to the support structure S in the direction of circulation, the openings in the fabric are extended or enlarged, so that the fibers of the nonwoven V1 are more easily driven through the same by the hydrodynamic action. Thus, the nonwoven layer V1 is compacted and at the same time fixed on the support structure S receiving the same. The composite of the support structure S and the nonwoven layer V1, formed by the hydrodynamic action, is shown enlarged in FIG. 1. Likewise, the support structure S prior to the application of the nonwoven layer V1 and to the hydrodynamic action is also shown enlarged.

The support structure S with the nonwoven V1 laid thereon circulates at least once, with a small overlap area being provided in addition. In this manner, a continuous strip—except for the overlap area—is formed that consists of the support structure S and a layer of the nonwoven V1 compacted and connected with the structure S by the hydrodynamic action thereon. When this strip S, V1 is relaxed and taken from the deflecting rollers U, US, the support structure S shrinks to its original dimension and the fixation of the fibers of the nonwoven V1 driven through the openings is increased.

Now, the strip S, V1 can be inverted and be placed around the deflecting rollers U, US with the nonwoven layer V1 in the inner side, whereupon the strip can be stretched. The strip S, V1 is circulated once again, with a second layer of nonwoven V2 being laid on the support structure S if the strip S, V1 from a roller of nonwoven VR2, the support structure now lying on top. By means of the nozzle bars D11, D12 cooperating with the suction drums, this second layer of nonwoven V2 is also compacted and fixed to the support structure S, as well as to the nonwoven layer V1 on the rear side. In this context, FIG. 2 illustrates the strip S, V, placed into the device of the present invention, in connection with two enlargements, where one enlargement illustrates the inverted strip S, V1—as obtained by the process illustrated in FIG. 1—and the other enlargement illustrates the strip V1, S, V2, having one layer of nonwoven V1, V2 on either side, after hydrodynamic action by means of the nozzle bars D21, D22.

FIG. 3 illustrates another embodiment of the invention, wherein both nonwoven layers V1, V2 are fed via two feeding devices RV1, RV2 associated with the two sides of the support structure S. The strip of the support structure S is guided around two suction drums ST1, ST2 by means of the deflecting rollers U, US, the suction drums respectively being arranged downstream of a respective feeding device RV1, RV2 and cooperating with nozzle bars D11, D12, D21, D22. The hydrodynamic action by the nozzle bars D11, D12, D21, D22 is performed once on the one side and thereafter on the other side of the support structure S such that the nonwoven layer V1, V2, previously brought into contacted with the support structure S, is exposed to hydrodynamic action while being on the top side.

FIG. 4 illustrates a further embodiment. It shows a device for receiving a support structure S designed as a continuous strip, the device being similar to the device of FIGS. 1 and 2. However, the device of FIG. 4 only has four deflecting rollers U1, U2, U3 and US and comprises a suction box SK instead of the suction drum. The suction box SK is arranged spaced from the support structure S. In the region of the suction box SK, at least one nozzle bar D31 is arranged above the support structure S. By means of the nozzle bar D31, the nonwoven V1 arranged on the first side of the support structure S can be acted upon using water jets so that the nonwoven V1 can be connected with the support structure S. The nonwoven V1 is connected with the support structure S by the fact that fibers of the nonwoven V1 pass through the openings in the support structure S when water jets act thereon. The suction box SK draws off the water passing through the nonwoven and the support structure S.

The support structure S designed as a continuous belt can be stretched by means of the deflecting roller US. The deflecting roller U1 is adapted to be driven. By rotating the deflecting roller U1, the support structure S can be circulated around the deflection roller U1, U2, U3 and US.

In the manner illustrated in FIG. 2, it is possible in the device illustrated in FIG. 4 to remove the support structure S designed as a strip, invert the same and stretch it over the deflecting rollers U1, U2, U3 and US again. Thus, a further nonwoven V2 can be laid on the second side of the support structure S, opposite the first side, and can also be acted upon by the nozzle bar D31 using water jets so that the second nonwoven V2 is also connected with the support structure S.

Instead of the suction drum, the embodiment shown in FIG. 3 may likewise comprise a suction box illustrated in FIG.4.

Further, at least one compacting means can be provided in all embodiments. The compacting means may have a compacting roller CR as shown in FIG. 5 or, preferably, a compacting band stretched around rollers. Such a compacting band may be arranged such that the respective compacting band presses the respective nonwoven onto the support structure and thereby compresses the same. Water jets can be applied onto the respective compressed nonwoven through the compacting band provided with openings.

LIST OF REFERENCE NUMERALS

S support structure, screen fabric
U deflecting roller
US deflecting roller, adjustable for stretching
V1 first nonwoven, first nonwoven layer
V2 second nonwoven, second nonwoven layer
V1R feeding device for first nonwoven, roll of nonwoven 1
V2R feeding device for second nonwoven, roll of nonwoven 2
ST1 first suction drum
ST2 second suction drum
D11 nozzle bar
D12 nozzle bar
D21 nozzle bar
D22 nozzle bar
SK suction box
D31 nozzle bar

The invention claimed is:

1. A device for producing a nonwoven composite fabric, wherein a nonwoven fabric layer is applied onto a support structure layer and connected to the support structure layer by means of water jet needling, comprising:

a plurality of deflecting rollers around which a support structure in the form of a screen or a mesh fabric is stretched and circulated, the support structure being designed as a continuous strip;

a feeding device for a nonwoven fabric, which is brought into contact and connected with the support structure and further moved in contact with the support structure; and a first water jet needling, device with a first water pressure and a second water jet needling device with a second pressure, wherein the second pressure is higher than the first pressure, the first and second water jet needling devices being configured to connect the nonwoven fabric to the support structure.

2. The device of claim 1, further comprising a stretching means by which the support structure is stretched in at least one direction in the region of the first and second water jet needling devices.

3. The device of claim 1, further comprising a compacting means by means of which the nonwoven supplied to the support structure is compressed onto the support structure and is supplied to the first and second water jet needling devices.

4. The device of claim 1, further comprising another feeding device for contacting another nonwoven fabric layer with the support structure on a side of the support structure opposite a side to which nonwoven fabric is contacted and further comprising at least a third water jet needling device configured to connect the another nonwoven fabric layer to the support structure while the another nonwoven fabric layer is in contact with the support structure.

5. The device of claim 2, wherein the stretching means comprises at least one of the plurality of deflecting rollers being an adjustable deflecting roller movable to tension the support structure in a circumferential direction.

6. The device of claim 3, wherein the compacting means comprises a compacting roller or a compacting band stretched around rollers.

7. A method for producing a nonwoven composite fabric, comprising:

stretching a support structure in the form of a continuous strip over a plurality of deflecting rollers and circulating the support structure around the deflecting rollers, laying a nonwoven on a first side of the support structure, and acting on the nonwoven laid on the support structure using water jets under pressure from a first water jet needling device with a first pressure and then using of water jets under pressure from a second water jet needling device with a second pressure so that the nonwoven is connected with the support structure, wherein the second pressure is higher than the first pressure.

8. The method of claim 7, wherein, in a region where the water jets are applied, the support structure is stretched in at least one direction by means of a stretching means.

9. The method of claim 7, further comprising laying a second nonwoven on a second side of the support structure, opposite the first side, and connecting the second nonwoven with the support structure by means of water jets under pressure.

10. The method of claim 9, wherein laying the second nonwoven on the second side of the support structure, opposite the first side, comprises inverting and repositioning the support structure with the nonwoven connected thereto over the plurality of deflecting rollers, the support structure around with the nonwoven connected thereto over the plurality of deflecting rollers, and laying the second nonwoven on the second side of the support structure.

11. The method of claim 10, wherein connecting the second nonwoven with the support structure by means of water jets under pressure comprises acting on the second nonwoven laid on the second side of the support structure using water jets under pressure from the first water jet needling device with a first pressure and then using water jets under pressure from the second water jet needling device with a second pressure so that the nonwoven is connected with the support structure, wherein the second pressure is higher than the first pressure.

12. The method of claim 9, wherein laying the second nonwoven on the second side of the support structure, opposite the first side, comprises laying the second nonwoven on the second side of the support structure from a feeding device different from a feeding device for laying the nonwoven on a first side of the support structure while stretching the support structure over the plurality of deflecting rollers and circulating the support structure around the deflecting rollers.

13. The method of claim 12, wherein connecting the second nonwoven with the support structure by means of water jets under pressure comprises acting on the second nonwoven laid on the second side of the support structure using water jets under pressure from at least a third water jet needling device.

14. The method of claim 7, further comprising compacting the nonwoven laid on the support structure before acting on the nonwoven laid on the support structure using water jet.

* * * * *